United States Patent [19]

Nozawa et al.

[11] 4,437,910

[45] Mar. 20, 1984

[54] PROCESS FOR PRODUCING GRAIN-ORIENTED ELECTROMAGNETIC STEEL SHEET

[75] Inventors: Tadao Nozawa, Munakata; Takaaki Yamamoto, Kitakyushu; Tadashi Nakayama, Kitakyushu; Fumio Matsumoto, Kitakyushu; Satohiro Hayami, Yokohama, all of Japan

[73] Assignee: Nippon Steel Corporation, Tokyo, Japan

[21] Appl. No.: 267,855

[22] Filed: May 28, 1981

[30] Foreign Application Priority Data

Jun. 4, 1980 [JP] Japan ..... 55-75033

[51] Int. Cl.[3] ..... H01F 1/04

[52] U.S. Cl. ..... 148/112; 148/111; 148/31.55

[58] Field of Search ..... 148/31.55, 110, 111, 148/112, 113

[56] References Cited

U.S. PATENT DOCUMENTS

| | | | |
|---|---|---|---|
| 2,992,952 | 7/1961 | Assmus et al. | 148/113 |
| 4,046,602 | 9/1977 | Stanley | 148/112 |
| 4,115,161 | 9/1978 | Datta | 148/113 |
| 4,123,299 | 10/1978 | Fiedler et al. | 148/112 |
| 4,174,235 | 11/1979 | Fiedler | 148/112 |

FOREIGN PATENT DOCUMENTS 988047 3/1965 United Kingdom .

*Primary Examiner*—John P. Sheehan

*Attorney, Agent, or Firm*—Wenderoth, Lind & Ponack

[57] ABSTRACT

In the secondary recrystallization of a grain-oriented silicon steel sheet, a specific temperature gradient is generated, thereby developing the secondary recrystallized grains having a good (110) [001] orientation and increasing the magnetic flux density higher than that previousy obtained. The temperature gradient is established at the boundary region between the primary and secondary recrystallized regions, with the result that highly oriented (110) [001] secondary recrystallization nuclei preferentially are caused to develop.

10 Claims, 5 Drawing Figures

PROCESS FOR PRODUCING GRAIN-ORIENTED ELECTROMAGNETIC STEEL SHEET

The present invention relates to a process for producing a so-called grain-oriented silicon steel sheet which has an easy direction of magnetization, i.e. <100> axis, in the rolling direction of a silicon steel sheet.

The grain-oriented silicon steel sheet is a soft magnetic material used mainly for the cores of electrical machinery and apparatuses, such as a transformer and the like, and for such uses should have good exciting and watt loss characteristics.

The reduction in size of electrical machinery and apparatuses, for example the transformer, the importance of which reduction is increasing recently, necessitates the reduction in weight of the cores. Generally speaking, in order to decrease the core weight of the electrical machinery and apparatuses, electromagnetic steels must be used for the cores under a high magnetic field where the magnetic flux density of the silicon steel sheets is high, with the result that such steel sheet is required to possess a good exciting property, i.e. a high $B_8$ value, which means the magnetic flux density at the magnetic field intensity of 800 A/T. The watt loss is, however, increased, when the grain-oriented electromagnetic steels are used for the cores at the high magnetic flux density. A grain-oriented electromagnetic steel having a higher $B_8$ value exhibits a considerably smaller increase of watt loss than that exhibited in steel having a lower $B_8$ value. In other words, the increasing rate of the watt loss due to the increase of the operating magnetic flux density is low when the $B_8$ value is high. This is a remarkable feature of the grain-oriented silicon steel sheets having a high magnetic flux density.

When the capacity of an electrical machinery and apparatuses is increased, in future, the electrical machinery and apparatuses must be so designed that the cores are energized under a high magnetic flux density. As understood from the foregoing descriptions, this is possible exclusively by using the grain-oriented silicon steel sheets with a high magnetic flux density.

From the viewpoint of reducing the core weight and meeting the capacity increase of the electrical machinery and apparatuses, a number of patent inventions have been proposed regarding grain-oriented electromagnetic steels having a high magnetic flux density. Several of these steels are industrially produced and have the $B_8$ value of approximately 1.92 T at the highest, which is an excellent $B_8$ value for industrially produced high magnetic flux density steels and which is considerably lower than the approximately 2.04 T of the theoretically maximum value of a 3% silicon steel. There is, therefore, much room for the improvement of the $B_8$ value. In addition, the grain-oriented electromagnetic steels with a normal magnetic flux density should desirably have a higher $B_8$ value than the presently achieved value. The present inventors, therefore, conducted systematic researches for enhancing the $B_8$ value of grain-oriented electromagnetic steels and discovered that the alignment of the <100> axis with the rolling direction can be outstandingly enhanced by a particular annealing condition during the secondary recrystallization.

The present inventors analyzed, from the viewpoint of the annealing condition, at the secondary recrystallization, the conventional annealing method for the secondary recrystallization, i.e. the final annealing or the final high temperature annealing. The technical concept of the conventional methods is that the entire steel sheet is uniformly heated or annealed and thus the secondary recrystallization simultaneously initiates at a plurality of separated positions of the sheet, followed by developing or growing the secondary recrystallized grains over the steel sheet. In other words, as far as the inventors are aware of the prior art, no technical concept of positively conducting a non-uniform heating and then effectively utilizing the temperature gradient generated by the non-uniform heating for the growth of secondary recrystallized grains is involved in the prior art. From the viewpoint of a temperature gradient, the temperature gradient is formed along the short width direction of a sheet even in a batch furnace which is industrially used for the final annealing. This temperature gradient is, however, spontaneous or unintentional and cannot achieve the desired growth control of the secondary recrystallized grains, because of the reasons explained in detail hereinbelow.

It is an object of the present invention to provide a process allowing for the production of a grain-oriented electromagnetic steel having a higher magnetic flux density than that possible by the conventional processes.

It is another object of the present invention to provide a recrystallization annealing method which is considerably improved over the conventional methods, considering the fact that the secondary recrystallized grains having a good orientation develop at an appropriate temperature.

In accordance with the objects of the present invention, the presently provided processes for producing a grain-oriented electromagnetic steel are improved by a secondary recrystallization annealing of the present invention. In the present invention, the secondary recrystallization proceeds toward the primary recrystallized grain region and is completed over the entire area of the steel sheet, while a temperature gradient is generated at the boundary region between the primary recrystallized grain region and the secondary recrystallized grain region formed upon reaching the secondary recrystalling temperature. The important feature of the temperature gradient annealing procedure resides in the fact that the degree of (110)[001] orientation becomes higher than that of conventional annealing methods.

In contrast to the secondary recrystallization method of the present invention, according to conventional methods no temperature gradient is generated at the boundary region between the primary and secondary recrystallized grain regions or if a temperature gradient is generated, it is only partly generated in the boundary region. In the present invention, the secondary recrystallization proceeds under the condition that the temperature gradient is necessarily formed at the boundary region, with the consequence that highly oriented (110)[001] grains are preferentially developed. The grounds for this can be explained as follows based on the basic knowledge of nucleation and its growth, as well as the following accepted three empirical rules concerning the secondary recrystallization of the grain-oriented electromagnetic steel.

A. The nucleation speed of the secondary recrystallized grains is higher when these grains are of a higher orientation. That is, the secondary recrystallized grains of higher orientation nucleate during a shorter period of time at a given temperature and during a given period of time at a low temperature as compared with those of the secondary crystallized grains of a lower orientation.

B. The growth speed of the secondary recrystallized grains is higher when these grains are of a higher orientation.

C. With reference to the nucleation speed and growth speed of the secondary recrystallized grains, the former is relatively high as compared with the latter at a high temperature and the latter relatively is high as compared with the former at a low temperature.

The secondary recrystallized grains of a high orientation are generated at a relatively low temperature during a temperature elevation (c.f. item A, above). If a temperature gradient is not generated in the steel, in which the secondary recrystallized grains are generated as stated above, the grains, which nucleate and then start to grow, are dispersed and are in the form of spots. While these grains further grow until the secondary recrystallization is completed, the primary crystallized grains, which are not yet secondarily recrystallized in the steel sheet subjected to the temperature elevation, undergo a high temperature and thus the nuclei of the secondary crystallized grains tend to generate in the primary crystallized grains. These nuclei are of a low orientation (c.f. item A, above). The tendency for nuclei of a low orientation being formed is more apparent when the temperature elevation rate is higher. A low rate of temperature elevation is, therefore, desirable for suppressing the generation of nuclei having a low orientation. When the rate of temperature elevation is low, the number of nuclei having a high orientation is very small because of items A and C, above. In order to complete secondary recrystallization of these nuclei, secondary recrystallization must be carried out for a long time, during which time the primary crystallized grains grow. Because of the growth of the primary crystallized grains, the driving force for the growth of the secondary recrystallized grains is decreased. The secondary recrystallization is, therefore, retarded not only due to the slow temperature elevation, but also due to the decrease of the driving force. Annealing without the temperature gradient will eventually result in an incomplete secondary recrystallized structure, in which coarse primary recrystallized grains remain. In other words, when a temperature gradient is not generated, the primary recrystallized grains remain even at a high temperature, and it is difficult to avoid the generation of nuclei having a low orientation.

On the other hand, when a temperature gradient is generated at the boundary region between the primary and secondary recrystallized grain regions, the steel material is divided at any time during the generation of the temperature gradient into a high temperature region (the secondary recrystallized grain region) and a low temperature region (the primary recrystallized grain region). In the primary recrystallized grain region, where the temperature is lower than in the secondary recrystallized grain region, the grain growth is suppressed. Therefore, when the previous low temperature region proceeds to a high temperature region, the growth of the secondary recrystallized grains is promoted due to the suppression of the grain growth mentioned above. This means that, in a case where the temperature gradient is generated, the boundary region between the primary recrystallized grain region and the secondary recrystallized grain region tends to be of a lower temperature or tends to be positioned in a lower temperature region of the steel sheet as compared with a case where the temperature gradient is not generated. This tendencey becomes much more apparent because of the item B, above, when secondary recrystallized grains are highly oriented. Only secondary recrystallized grains having a high orientation can be grown under the temperature gradient, because the primary recrystalized grain region is not subjected to a high temperature. The reason for this can be explained by the items A and B, above.

In one aspect of the present invention, which could be explained as stated above, the secondary recrystallization is carried out in such a manner that the secondary recrystallized grains at a high temperature region of the steel sheet encroach on the primary recrystallized grains of a low temperature region where the grain growth is suppressed.

In another aspect of the present invention, a higher temperature gradient than the conventional unintentional gradient is generated at the boundary region between the primary and secondary recrystallized grain regions, with the result that the secondary recrystallized grains of a high orientation are grown on the region, which has previously been the primary recrystallized region and has not been subjected to a high temperature. By this secondary recrystallization, the $B_8$ value and watt loss are very superior to the conventional $B_8$ value and watt loss. In a specific embodiment of the temperature gradient, the temperature gradient of a steel sheet is 0.5° C./cm or higher, preferably 2° C./cm or higher.

In another aspect of the present invention, the temperature gradient exists at the boundary region between the primary and secondary recrystallized grain regions and is progressively displaced from one region or part of the steel sheet to the other regions or parts, until the secondary recrystallization of the entire steel sheet is completed. In a specific embodiment of the present invention, the temperature gradient may be in any direction of the short width direction, longitudinal direction or an intermediate direction of the first two directions. The temperature gradient does not need to be constant, but may be varied at a position of the steel sheet under the temperature gradient. In addition, the direction of the temperature gradient does not need to be a specified single direction at every position of the steel sheet, but may be different at various positions of the steel sheet. The steel may be in the form of a sheet, coil or strip, and the annealing may be continuous or batch type.

The present invention is hereinafter explained in detail with regard to the embodiments thereof.

The steel, which is the object of the process according to the present invention may be any steel adapted to be secondarily recrystallized, thereby enhancing the alignment of the <100> axis with regard to the rolling direction and thus manufacturing the grain-oriented electromagnetic steel used in the electrical machinery and apparatuses. The composition of the steel is not specifically limited and any steel, which is now industrially used, can also be used in the present invention. The steel may contain not more than 4.5% of silicon and a minor amount of at least one inhibitor element necessary for the secondary recrystallization and selected from the group consisting of manganese (Mn), sulfur (S), aluminum (Al), nitrogen (N), selenium (Se), antimony (Sb), tellurium (Te), copper (Cu) and boron (B). This composition is, however, illustrative but not limitative of the steels that can be used in the process of the present invention. The steel having such composition as described above is referred to as silicon steel and is available in the form of a sheet or strip. The term sheet used herein collectively indicates both sheet and strip unless specifically mentioned. The sheet can be produced by a process, in which a steel slab is formed by either continuous casting or ingot making and is then subjected to a hot rolling and a cold rolling (a single stage cold rolling or a double stage cold rolling with an intermediate annealing). The sheet is then decarburization-annealed and finally annealed so as to conduct the secondary recrystallization and purification. In the process explained above, the annealing disclosed in the Japanese second patent publication No. 23,820/1971 may be employed for annealing the hot rolled sheet or an annealing prior to the final cold rolling, if necessary. An annealing separator is preliminarily applied onto the steel sheet before the final annealing when the steel sheet finally annealed is in the form of a coil or laminated sheets or strips. The decarburization-annealing is not necessary, when the silicon steel is cast as an extremely low carbon steel. In summary, the manufacturing processes, which have heretofore been developed for the production of grain-oriented silicon steel sheets can be applied to the process of the present invention except for the the secondary recrystallization annealing with the temperature gradient. There are no specific limitations as to the process conditions other than the secondary recrystallization annealing with the temperature gradient.

The main feature of the present invention resides in how the silicon steel is treated in the final annealing, particularly at the temperature range of the secondary recrystallization. The essence of the present invention is, as understood from the descriptions hereinabove, to subject the steel sheet to a temperature gradient at the boundary region between the primary and secondary recrystallized regions of the steel sheet. In order to generate the temperature gradient in a strip coil, which is the form of the steel sheet finally-annealed on an industrial scale, a detachable heat-insulation is provided around the strip coil and is removed along a predetermined direction. This is one possible method for generating the temperature gradient on the strip coil.

Continuous type annealing methods for the final annealing are proposed in patent inventions, and, in these methods, a piece of the steel sheet or laminated steel sheets including a sheared sheet(s), are continuously conveyed through a furnace. In the continuous type annealing methods, a zone of the furnace is positively provided with such a temperature gradient that the temperature gradient is generated on the boundary region between the primary and secondary recrystallized regions.

When the steel sheet is heated to a secondary recrystallization temperature while it is subjected to the temperature gradient, the secondary recrystallized grains, which are formed upon reaching the secondary recrystallized temperature, and the primary recrystallized grains, which have not yet reached the secondary recrystallization temperature, are mixed as seen in the cross section of the steel sheet. The region of the steel sheet, where the mixed structure of the primary and secondary grains are formed, is the boundary region, and the boundary region is formed along an isothermal line of the steel sheet. With the increase in the temperature of the steel sheet, the boundary region is moved toward a low temperature side or the primary recrystallized grain region, thereby spreading the secondary recrystallized grain region and developing the secondary recrystallization. During this procedure of the movement of the boundary region due to the heating of the steel sheet, the temperature of the boundary region can be maintained relatively constant. The temperature of the boundary region is relatively constant during the procedure mentioned above, but is varied depending on the kind of the steel sheet and the annealing condition. It is, therefore, impossible to numerically specify the temperature range of the boundary region. For example, the temperature of the boundary region ranges from 950° to 1100° C., when a grain oriented silicon steel sheet with a high magnetic flux density contains 3% Si and MnS and AlN as the inhibitors. The temperature gradient according to the present invention must be generated at least on the boundary region. That is, the regions having higher and lower temperatures than that of the boundary region may be treated as in a conventional annealing or in the annealing method of the present invention with the temperature gradient.

One of the functions of the temperature gradient according to the present invention is to suppress the development of the secondary recrystallized grains having a low orientation and to promote a preferential development of the secondary recrystallized grains having a high orientation. It seems that, in order to further effectively exhibit the $B_8$ valueenhancing effect of the temperature gradient, the temperature-elevating rate of the boundary region between the primary and secondary recrystallized grain regions needs to be determined in relation to the temperature gradient and also the kinds of silicon steels and the process history of the steel sheet need to be considered. Generally speaking, the temperature-elevation rate at the region of the steel sheet where the secondary recrystallization proceeds, should be low in order to obtain a high $B_8$ value. However, if the temperature-elevating rate is too low to cause a grain growth of the primary recrystallized grains, the coarse primaries remain in the final product and this results in an incomplete secondary recrystallization. An appropriate range of the temperature elevation is determined in the conventional processes from the consideration of the above points. Since the temperature gradient of the present invention stabilizes the secondary recrystallization, the upper and lower limits of an appropriate rate of temperature elevation are higher and lower than those of the conventional processes, respectively. This effect is more apparent at a higher temperature gradient. For example, at a temperature gradient of 70° C./cm, the $B_8$ value of the steel sheet of Example 1, below, is high even when the temperature of the steel sheet is elevated at a rate of 70° C./min. It will be, therefore, very obvious that an appropriate range of the temperature-elevation rate in the conventional processes completely falls within the range of the present invention. In the secondary recrystallization method of the present invention, it is can be applied not only for the steel, which can be satisfactorily secondary-recrystallized without subjecting it to the temperature gradient, but also for the steel, in which the secondary recrystallization would not satisfactorily develop by using the conventional annealing methods, and also a high magnetic flux density can be obtained. The conventional methods to be carried out prior to the secondary recrystallization stage are not limitative of the present invention at all. The present invention will make it possible to employ, for the production of a grain-oriented silicon steel with a high density, such methods which were thought impossible to employ previously.

The stabilizing effect of the temperature gradient on the secondary recrystallization will be further illustrated by using a specific experiment.

The same hot-rolled steel sheet as that which will be described in Example 1 below, was treated under the same conditions as those stated in Example 1, except that the draft percentage in the cold rolling procedure was increased so as to adjust the thickness of the resultant primary-recrystallized steel sheet to 0.24 mm. The amealing separator (MgO) was applied to the steel sheet.

The steel sheet was divided into two specimens A and B and each subjected to one of the following secondary recrystallization annealing procedures.

Procedure 1

Specimen A was heated up to 650° C., which was the highest temperature found in the specimen, at a heating rate of 100° C./hr., and, then, up to 1200° C. at a rate of 10° C./hr. in an annealing furnace with a 25 vol % $N_2$ and 75 vol % $H_2$ atmosphere. A temperature gradient of 7° C./cm was generated in the part of the specimen located in a heating zone having a temperature of 980° to 1100° C. The direction of the temperature gradient was parallel to the rolling direction applied to the steel sheet.

After the entire body of the specimen reached 1200° C., the specimen was subjected to a purification annealing procedure within a pure hydrogen ($H_2$) atmosphere at a temperature of 1200° C. for 20 hours.

Procedure 2

The other Specimen B was subjected to the same operations as those described is Procedure 1, except that no temperature gradient was generated.

The macrostructure of the annealed Specimen A is indicated in FIG. 4A wherein the secondary recrystallization was completely effected because the annealing procedures of the present invention were applied to the specimen. The annealed specimen exhibited a satisfactory $B_8$ value of 1.98 Tesla.

However, in the case where an excessively high degree of cold rolling was applied to the steel sheet and no temperature gradient was generated on Specimen B, the secondary recrystallization annealing was incompletely effected. This feature is clearly indicated in FIG. 4B.

As described in detail hereinabove, the temperature gradient of the present invention is a novel technique which stabilizes the secondary recrystallization and which makes possible the preferential development of highly oriented secondary recrystallized grains. The secondary recrystallization phenomena under this temperature gradient are believed to be realized in the whole grain-oriented silicon steels and, also, to be influenced by neither the composition of the steels nor the process which has been applied to the steel prior to the secondary recrystallization.

Examples of the present invention are now explained with reference to the following drawings.

EXAMPLE 1

Continuously cast slabs, which contained 0.053% of carbon, 2.95% of silicon, 0.081% of manganese, 0.026% of sulfur, 0.028% of aluminum and 0.0081% of nitrogen, were subjected to hot rolling, annealing, cold rolling and decarburization annealing. An annealing separator (MgO) is applied on the so obtained 0.3 mm thick primary-recrystallized steel sheets and is then annealed by the following procedure. The steel sheet specimens were heated at a rate of 50° C./hour from room temperature to 950° C. and at a rate of 20° C./hour from 950° to 1200° C. in an annealing furnace with a 25 vol % $N_2$ and 75 vol % $H_2$ atmosphere. The temperature gradients were generated on the part of the steel sheet specimens situated in a zone of the annealing furnace with the temperature from 980° to 1100° C., so that they are 0° C./cm, no temperature gradient annealing 0.5° C./cm, 1° C./cm, 2° C./cm and 5° C./cm. The annealing furnace had a length of approximately 1 m and the heating section of the furnace was divided into three zones. The temperature gradients were generated by separately adjusting the temperature of the three zones of the furnace. The direction of the temperature gradients was parallel to the sheet width.

The steel sheet specimens were subsequently subjected to a purification annealing within a pure hydrogen ($H_2$) atmosphere at a temperature of 1200° C. over a period of 20 hours. The $B_8$ value of the products is shown in FIG. 1.

Figure 1:
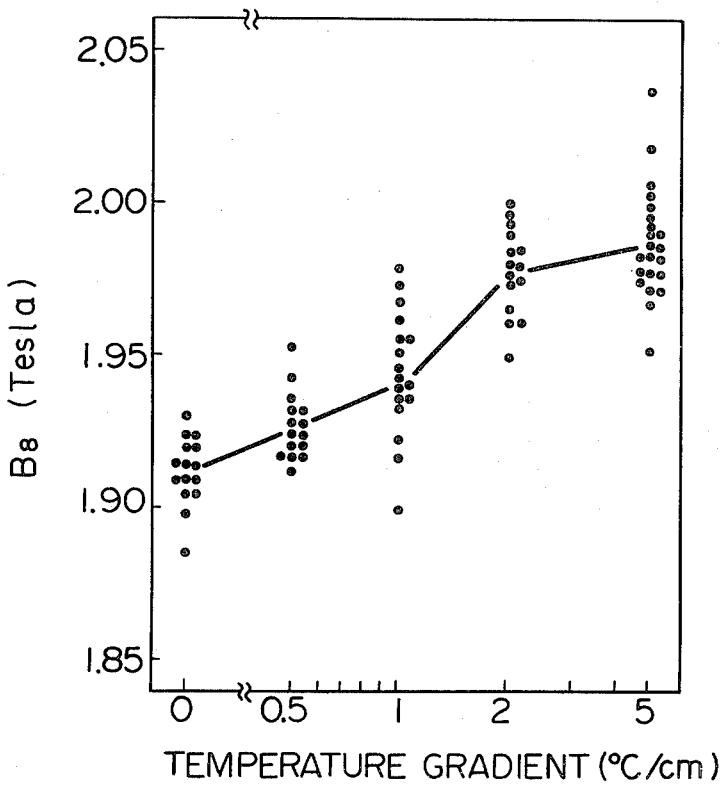
FIG. 1 illustrates a relationship between the temperature gradient and the $B_8$ values of the products of Example 1.

As is apparent from FIG. 1, the $B_8$ value is appreciably enhanced by the temperature gradient of 0.5° C./min and is remarkably enhanced by the temperature gradient of 2° C./min or higher. Although a high temperature gradient can stabilize the secondary recrystallization and the high level of the $B_8$ value, the grain growth of secondary recrystallized grains may be caused when the temperature gradient is very high. Such grain growth may result in the increase of the width of 180° domains and thus deterioration of the watt loss. The temperature gradient may, however, be as high as possible, when it is possible to refine the width of 180° domains. The upper limit of the temperature gradient is not specifically limited in this case. In a case where the refinement of the width of 180° domains is difficult, the maximum temperature gradient should be such that the watt loss is the lowest.

EXAMPLE 2

Continuously cast slabs, which contained 0.035% of carbon, 2.93% of silicon, 0.08% of manganese, and 0.024% of sulfur, were subjected to hot rolling, annealing, primary cold rolling, an intermediate annealing, a secondary cold rolling and a decarburization annealing.

The so-obtained 0.3 mm thick primary-recrystallized steel sheets, on which the annealing separator was preliminarily applied, was annealed by the same procedures as in Example 1 except for the following. The steel sheet specimens were heated at a rate of 50° C./hour from room temperature to 750° C. and at a rate of 20° C./hour from 750° to 1200° C. The temperatue gradients were generated on the part of the steel sheet specimens situated in a zone of the annealing furnace with the temperature from 800° to 1200° C., so that they are 0° C./cm (no temperature gradient) and approximately 3° C./cm.

The $B_8$ value of the products is shown in Table 1.

TABLE 1

| Temperature Gradient | $B_8$ Value (Tesla) |
|---|---|
| No temperature gradient | 1.84 |
| 3° C./cm | 1.87 |

Note:
The $B_8$ value is the average value of ten specimens.

When one takes into consideration both Examples 1 and 2, it will be apparent that the temperature gradient is effective for enhancing the $B_8$ value of the steel sheet specimens containing different inhibitor elements and subjected to different procedures until the primary recrystallization takes place.

EXAMPLE 3

Figure 2:
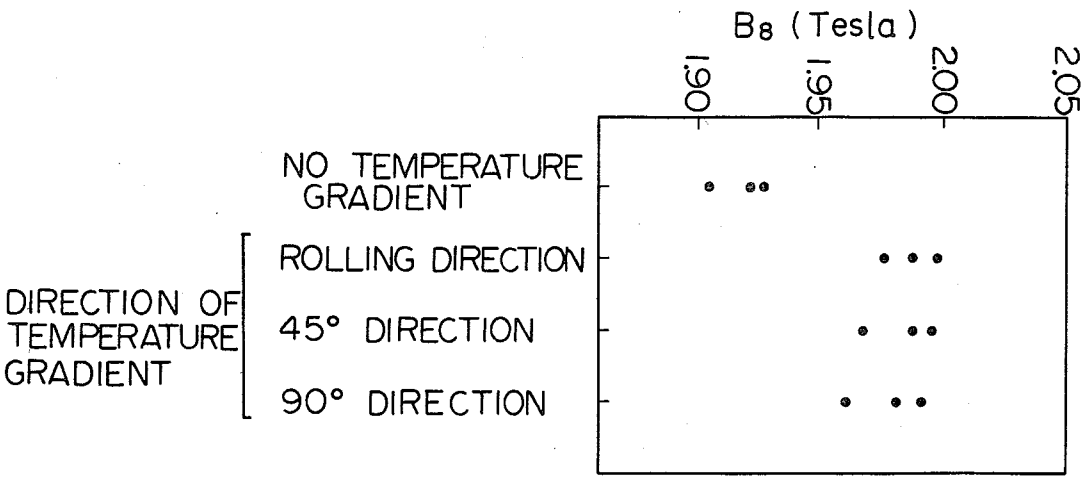
FIG. 2 illustrates a relationship between the $B_8$ values and the temperature gradient with regard to the products of Example 3.
Figure 3:
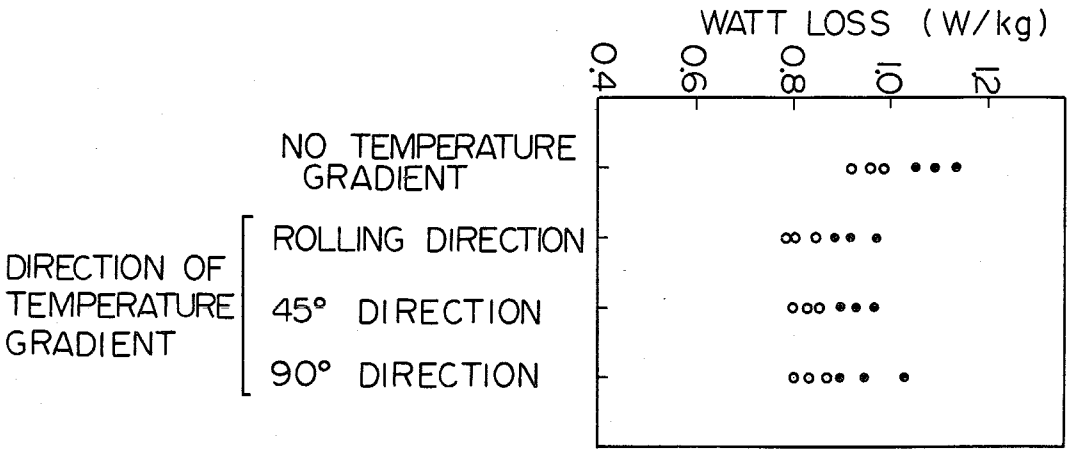
FIG. 3 illustrates a relationship between the watt loss and the temperature gradient with regard to the products of Example 3.
Figure 4B:
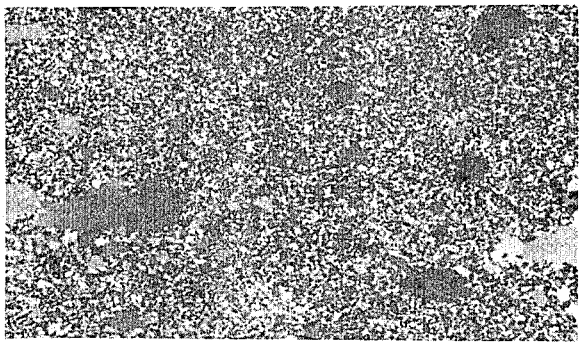
FIG. 4B shows a microscopic view of an incompletely secondary recrystallization-annealed steel strip.
Figure 4A:
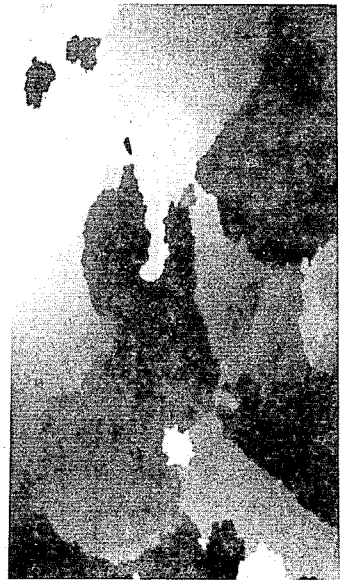
FIG. 4A shows a microscopic view of a secondary recrystallization-annealed steel sheet of the present invention.

The same steel sheet specimens having the thickness of 0.3 mm, as in Example 1, were subjected to the same procedure as in Example 1 except that: the temperature gradients at a temperature region of from 950° to 1100° C. were 0° C./cm (no temperature gradient annealing) and 3° C./cm; and, the direction of the temperature gradient was in the rolling direction and 45° and 95° from the rolling direction. The $B_8$ value and the watt loss property of the products are shown in FIGS. 2 and 3, respectively. It will be apparent from FIG. 2 that the direction of the temperature gradient is not specifically limited. The watt loss property of the 0.3 mm thick sheets shown in FIG. 3 is remarkably enhanced by the temperature gradient. In FIG. 3, the symbol • indicate the watt loss of the products having a glass film. The symbol O indicates that, in accordance with the disclosure of Japanese first patent publication No. 137,016/1978, a linear minute stress is generated by a ball-point pen on one side of the steel sheet specimens in the direction perpendicular to the rolling direction.

EXAMPLE 4

The same steel sheet specimens as in Example 1 were conveyed at a speed of 1 cm/min through a furnace (25 vol % $N_2$-75 vol % $H_2$) held at a temperature of 1200° C., and the secondary recrystallization took place during the time the specimens were conveyed through the furnace. The furnace is of a type capable of annealing a strip and is provided with a water cooled slit which generates a temperature gradient. The temperature of the boundary region between the primary and secondary recrystallized regions was about 950° C., and the temperature gradient generated at the boundary region was about 70° C./cm. The steel sheet specimens were, separately after the secondary recrystallization, subjected to a purification annealing in a hydrogen ($H_2$) gas atmosphere at 1200° C. for 20 hours. The average $B_8$ value of the ten specimens was 1.98T.

The above procedure was repeated except that the steel sheet specimens were conveyed at a speed of about 10 cm/hr. and were simultaneously subjected to a temperature gradient of from about 2° C./cm over a temperature region of from 980° to 1030° C.

The $B_8$ value of the products is given in Table 2.

TABLE 2

| Temperature gradient (°C./cm) | $B_8$ value (Tesla) |
|---|---|
| 2 | 1.97 |
| 70 | 1.98 |

It will be apparent from this example that the temperature gradient is effective for enhancing the $B_8$ value not only in box annealing, but also in continuous annealing.

EXAMPLE 5

A continuous casting slab, which contained 0.057% of carbon, 3.01% of silicon, 0.79% of manganese, 0.025% of sulfur, 0.028% of aluminum and 0.0079% of nitrogen, was subjected to a hot rolling, annealing, cold rolling, decarburization annealing and application of an annealing separator (MgO), thereby producing a 0.3 mm thick strip with the annealing separator. This strip, in the form of a coil, was annealed under the following procedure.

The annealing furnace was of a box type, and the coil was heated at a rate of 20° C./hour from room temperature to 900° C. and at a rate of 15° C./hour from 900° to 1200° C. within a 25 vol % $N_2$ and 75 vol % $H_2$ atmosphere. During the heating, the temperature gradient was generated in the width direction of the coil by means of: covering with an insulating material the inner and outer peripheral surfaces of the coil; heating the coil by the heat from the top part of an inner cover; withdrawing the heat from the bottom surface of the coil which was placed on a base plate; and, successively removing the insulating material. The so-generated temperature gradient was at least 5° C./cm at the temperature range of from 950° to 1100° C. and in the width direction of the coil. The obtained $B_8$ value was 1.98 Tesla.

We claim:

1. In a process for producing a grain-oriented silicon steel sheet with secondary recrystallized grains having a high degree of (110)[001] orientation and increased magnetic flux density by a secondary recrystallization annealing of a silicon steel sheet having a primary recrystallized structure, the improvement wherein the secondary recrystallization proceeds towareds the primary recrystallized grain region and is completed over the entire area of the steel sheet, while a temperature gradient of not less than 2° C./cm is generated in any direction of the short width direction, longitudinal direction or intermediate direction of said first two directions of the steel sheet at the boundary region between the primary recrystallized grain region and the secondary recrystallized grain region formed upon reaching the secondary recrystallizing temperature.

2. A process according to claim 1, wherein the temperature gradient is in the short width direction of the steel sheet.

3. A process according to claim 1, wherein the temperature gradient is in the longitudinal direction of the steel sheet.

4. A process according to claim 1, wherein the temperature gradient is in an intermediate direction between the short width direction and the longitudinal direction of the steel sheet.

5. A process according to claim 1, wherein the direction of the temperature gradient is different at various positions of the steel sheet.

6. A process according to claim 1, wherein the steel sheet is in the form of a coil.

7. A process according to claim 1, wherein the steel sheet is in the form of a sheet bar.

8. A process according to claim 1, wherein the steel sheet is in the form of a strip.

9. A process according to claim 1, wherein the steel sheet is annealed continuously or batchwise.

10. A grain-oriented silicon steel sheet with secondary recrystallized grains having a high degree of (110)[001] orientation and increased magnetic flux density produced by a process in which a silicon steel sheet having a primary recrystallized structure is primary recrystallization annealed in such a manner that the secondary recrystallization proceeds toward the primary recrystallized grain region and is completed over the entire area of the steel sheet, while a temperature gradient of not less than 2° C./cm is generated in any direction of the short width direction, longitudinal direction or intermediate direction of said first two directions of the steel sheet at the boundary region between the primary recrystallized grain region and the secondary recrystallized grain region formed upon reaching the secondary recrystallizing temperature.

* * * * *